US006948499B2

(12) United States Patent
Griesbach, III et al.

(10) Patent No.: US 6,948,499 B2
(45) Date of Patent: Sep. 27, 2005

(54) EASY GRIPPING FACE MASK

(75) Inventors: Henry L. Griesbach, III, Clarkston, GA (US); Linda G. Harris, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/253,771

(22) Filed: Sep. 24, 2002

(65) Prior Publication Data

US 2004/0055605 A1 Mar. 25, 2004

(51) Int. Cl.[7] ..... A62B 18/08

(52) U.S. Cl. ..... 128/206.25; 128/205.27; 128/206.14; 128/206.19

(58) Field of Search ..... 128/202.24, 202.13, 128/205.25, 205.27, 206.14, 206.19, 206.25, 863; 2/206, 9

(56) References Cited

U.S. PATENT DOCUMENTS

| | | | | |
|---|---|---|---|---|
| 1,317,947 A | | 10/1919 | Soderling | |
| 2,012,505 A | * | 8/1935 | Goldsmith | 128/863 |
| 2,079,582 A | | 5/1937 | Whipple | |
| 2,112,960 A | | 4/1938 | Harvey | |
| 2,290,885 A | | 7/1942 | Lehmberg | |
| 2,317,608 A | | 4/1943 | Heidbrink | |
| 2,378,929 A | | 6/1945 | Joyce | |
| 2,391,565 A | | 12/1945 | Grindrod et al. | |
| 2,391,677 A | | 12/1945 | Bulbulian | |
| 2,921,581 A | * | 1/1960 | Swearingen et al. | 128/206.25 |
| 2,928,387 A | | 3/1960 | Layne | |
| 3,038,470 A | * | 6/1962 | Campbell | 128/206.16 |
| 3,049,121 A | * | 8/1962 | Brumfield et al. | 128/206.14 |
| 3,220,409 A | * | 11/1965 | Liloia et al. | 128/206.19 |
| 3,308,816 A | | 3/1967 | Franklin et al. | |
| 3,338,992 A | | 8/1967 | Kinney | |
| 3,341,394 A | | 9/1967 | Kinney | |
| 3,502,763 A | | 3/1970 | Hartman | |
| 3,542,615 A | | 11/1970 | Dobo et al. | |
| 3,602,913 A | * | 9/1971 | Neese | 2/9 |
| 3,692,618 A | | 9/1972 | Dorschner et al. | |
| 3,695,265 A | * | 10/1972 | Brevik | 128/206.14 |
| 3,768,100 A | * | 10/1973 | Colman et al. | 2/9 |
| 3,802,817 A | | 4/1974 | Matsuki et al. | |
| 3,849,241 A | | 11/1974 | Butin et al. | |
| 3,881,632 A | | 5/1975 | Early et al. | |
| 3,953,566 A | | 4/1976 | Gore | |
| 4,014,616 A | | 3/1977 | Mast, Jr. et al. | |
| 4,041,203 A | | 8/1977 | Brock et al. | |
| 4,167,185 A | | 9/1979 | Lewis | |
| 4,187,390 A | | 2/1980 | Gore | |

(Continued)

FOREIGN PATENT DOCUMENTS

| | | |
|---|---|---|
| EP | 758009 | 3/1999 |
| WO | WO 89/01902 | 3/1989 |
| WO | 98/54991 | 12/1998 |
| WO | 99/61089 | 12/1999 |
| WO | 00/69497 | 11/2000 |
| WO | 02/49467 | 6/2002 |

OTHER PUBLICATIONS

*American Society for Testing and Materials*, ASTM Designation: D 2979–88, "Standard Test Method for Pressure–Sensitive Tack of Adhesives Using an Inverted Probe Machine", Oct. 1998, pp. 194–196.

*Primary Examiner*—Aaron J. Lewis
(74) *Attorney, Agent, or Firm*—Dana E. Stano; Scott B. Garrison

(57) ABSTRACT

A cup-shaped face mask sized to fit over the nose and mouth of a wearer is disclosed. The face mask includes an inside surface, an outside surface, and a tab disposed on and extending outwardly from the outside surface, where the tab is adapted for gripping.

18 Claims, 3 Drawing Sheets

U.S. PATENT DOCUMENTS 4,215,682 A 8/1980 Kubik et al.
4,269,315 A * 5/1981 Boyce ..... 206/438
4,296,746 A 10/1981 Mason, Jr. et al.
4,340,563 A 7/1982 Appel et al.
4,354,489 A * 10/1982 Riaboy ..... 128/206.14
4,374,888 A 2/1983 Bornslaeger
4,375,718 A 3/1983 Wadsworth et al.
4,454,881 A 6/1984 Huber et al.
4,467,799 A * 8/1984 Steinberg ..... 128/206.14
4,550,856 A 11/1985 Ballmann et al.
4,592,815 A 6/1986 Nakao
4,643,182 A 2/1987 Klein
4,657,010 A 4/1987 Wright
4,688,566 A * 8/1987 Boyce ..... 128/206.19
4,726,365 A * 2/1988 Jablonski ..... 128/202.13
4,807,619 A 2/1989 Dyrud et al.
4,817,636 A 4/1989 Woods
4,856,535 A 8/1989 Forbes
4,874,659 A 10/1989 Ando et al.
4,945,574 A 8/1990 Dagher
4,951,664 A 8/1990 Niemeyer
4,969,473 A 11/1990 Bothwell
5,012,952 A 5/1991 Franz
5,014,878 A 5/1991 Janz
5,033,115 A 7/1991 Bowling et al.
5,067,633 A 11/1991 Grosz et al.
5,145,727 A 9/1992 Potts et al.
5,156,911 A 10/1992 Stewart
5,169,706 A 12/1992 Collier, IV et al.
5,178,931 A 1/1993 Perkins et al.
5,188,885 A 2/1993 Timmons et al.
5,201,869 A 4/1993 Roethel
5,237,986 A 8/1993 Seppala et al.
5,357,947 A * 10/1994 Adler ..... 128/201.13
5,374,458 A 12/1994 Burgio
5,387,450 A 2/1995 Stewart
5,401,446 A 3/1995 Tsai et al.
5,414,867 A 5/1995 Bowling et al.
5,419,318 A * 5/1995 Tayebi ..... 128/205.27
5,538,013 A 7/1996 Brannon
5,561,863 A 10/1996 Carlson, II
5,618,281 A 4/1997 Betrabet et al.
5,640,974 A 6/1997 Miller
5,658,270 A 8/1997 Lichstein
5,682,879 A 11/1997 Bowers
5,690,121 A 11/1997 Miller
5,724,964 A 3/1998 Brunson et al.
5,753,343 A 5/1998 Braun et al.
5,803,077 A 9/1998 Gazzara
5,819,731 A 10/1998 Dyrud et al.
5,865,196 A * 2/1999 Foote ..... 132/319
5,883,026 A 3/1999 Reader et al.
5,918,598 A 7/1999 Belfer et al.
5,934,275 A 8/1999 Gazzara
5,954,055 A 9/1999 Miyake
6,055,982 A 5/2000 Brunson et al.
6,070,580 A 6/2000 McDonald et al.
6,095,143 A 8/2000 Dyrud et al.
6,098,201 A 8/2000 Boros, Sr.
6,135,988 A 10/2000 Turner et al.
6,148,817 A 11/2000 Bryant et al.
6,196,223 B1 3/2001 Belfer et al.
6,308,330 B1 10/2001 Hollander et al.
6,341,606 B1 1/2002 Bordewick et al.
6,394,090 B1 5/2002 Chen et al.
6,401,716 B1 6/2002 Sword et al.

* cited by examiner

EASY GRIPPING FACE MASK

BACKGROUND OF THE INVENTION

Disposable face masks have been manufactured for many years. In the medical field, early masks were designed to protect patients from pathogens contained in the exhaled air of health care personnel. In recent years, it has likewise become important to protect the health care personnel from airborne pathogens emitted by patients.

During surgical procedures, health care personnel are often required to enter and exit sterile environments to obtain equipment, supplies, and the like. Upon entry into an examination or surgical area, the health care worker dons a face mask for protection of himself and of the patient. However, face masks that are currently available require use of both hands to be properly donned. As a result, the worker may have to either place the supplies or equipment on a surface to properly don the mask, or may have to simply hold the mask in position while transporting the supplies.

There is currently a need for a face mask that is easy to don so that proper mask usage is encouraged. More particularly, a need exists for a face mask that may be donned with a single hand so the sterility of the examination or surgical environment is not compromised.

SUMMARY OF THE INVENTION

The present invention is generally directed to a face mask sized to fit over the nose and mouth of a wearer and easy to grip with a single hand for donning.

The present invention relates to a face mask having an inside surface, an outside surface, and a tab disposed on and extending outwardly from the outside surface, where the tab is adapted for gripping. The tab may be integral with the outside surface, or may be affixed to the outside surface. The inside surface includes a periphery that may have an adhesive material disposed on at least a portion thereof.

The present invention further relates to a stack of face masks, where the stack is formed from a plurality of shaped face masks. The masks include an inside surface having a periphery, an outside surface, and a tab disposed on and extending outwardly from the outside surface, where the tab is adapted for gripping. The masks are positioned in a nestled relation to one another, the inside surface of the mask being apposed to the outside surface of an adjacent mask, such that the tab maintains a distance between apposed masks so that the periphery of a mask does not contact the outside surface of an apposed mask.

DESCRIPTION OF THE INVENTION

Figure 1:
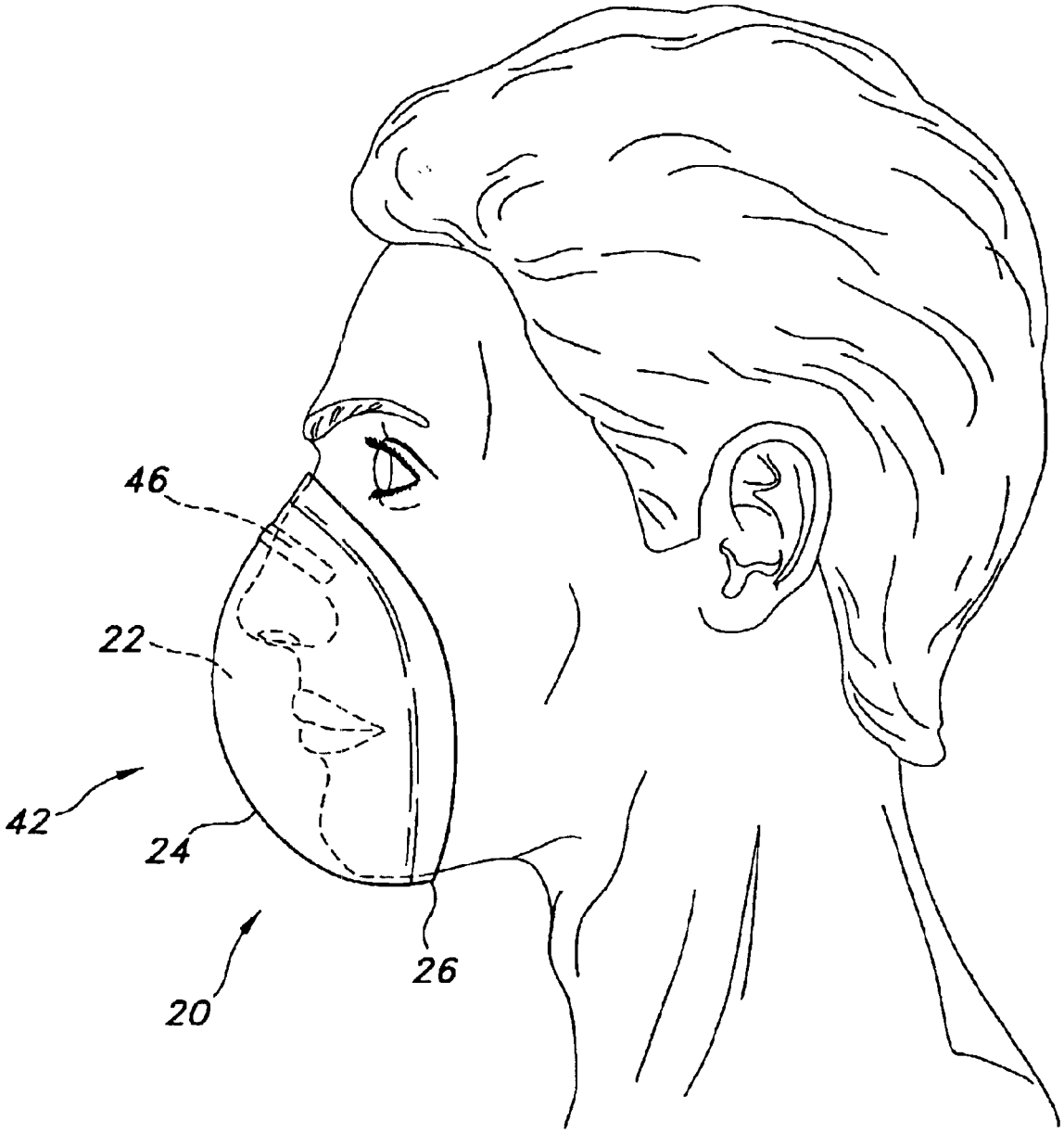
FIG. 1 is a side plan view of an exemplary cup shaped face mask donned by a wearer.

The present invention relates to a face mask that is designed to be gripped with a single hand. The present invention further relates to a stack of such face masks. One embodiment of a face mask 20 is illustrated in FIG. 1. However, it should be understood that other embodiments are encompassed by the present invention.

The face mask 20 is generally sized to fit over the nose and mouth of a wearer, and includes an inside surface 22, i.e., the surface proximal to the face of the wearer, and an outside surface 24, i.e., the surface distal to the face of the wearer. The inside surface 22 includes a periphery 26 that is adapted to engage the face of the wearer when the mask is donned. The periphery 26 is generally a flange, and may be folded as in FIGS. 2 and 3, flared as in FIGS. 4 and 5, or any other configuration (not shown), provided that the contact area with the face of the wearer is sufficient.

The present invention relates to any style or configuration of shaped face mask that is sufficiently rigid so that the mask may be gripped with a single hand without crushing or collapsing. As used herein, the term "shaped" means having a resilient structure that is able to retain its form and dimension. A shaped face mask may be dispensed and donned without crushing or collapsing. While sufficient rigidity is required for handling, the mask must also be somewhat flexible so that the periphery of the mask is able to substantially conform to the contours of the wearer's face. In some embodiments, the mask may be cup shaped as in FIGS. 1, 2, 4, and 5. In other embodiments, the mask may be cone shaped (not shown). Various techniques may be used to increase the rigidity of the mask. In some embodiments, the mask may be thermally molded or heat set to increase stiffness. In other embodiments, binder chemicals may be added to the materials prior to formation of the mask.

Figure 2:
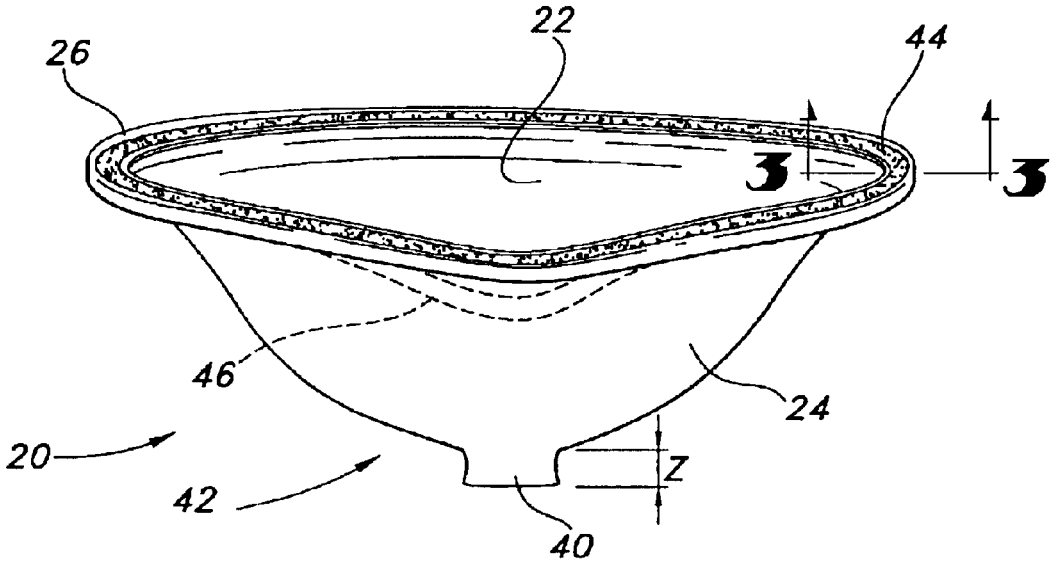
FIG. 2 is a perspective view of a cup shaped face mask having a folded edge periphery and an integral tab positioned so that the mask can be gripped with a single hand.
Figure 3:
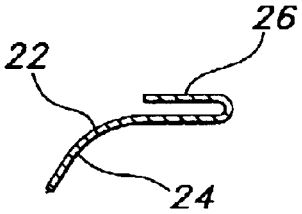
FIG. 3 is a broken-away side plan view of a the folded edge periphery of the mask depicted in FIG. 2 taken along a line 2—2.
Figure 4:
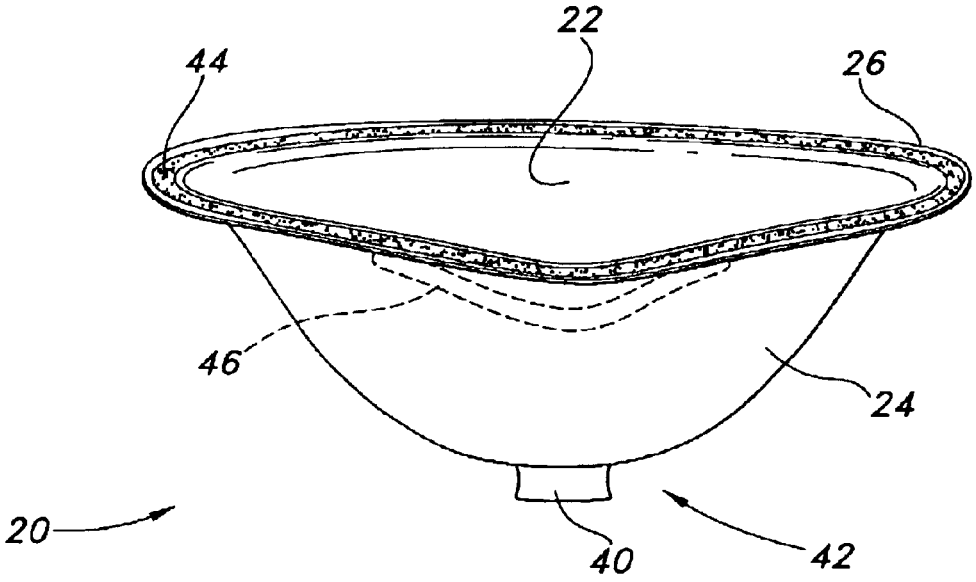
FIG. 4 is a perspective view of a cup shaped face mask having a flared edge periphery and a tab affixed so that that the mask can be gripped with a single hand.
Figure 5:
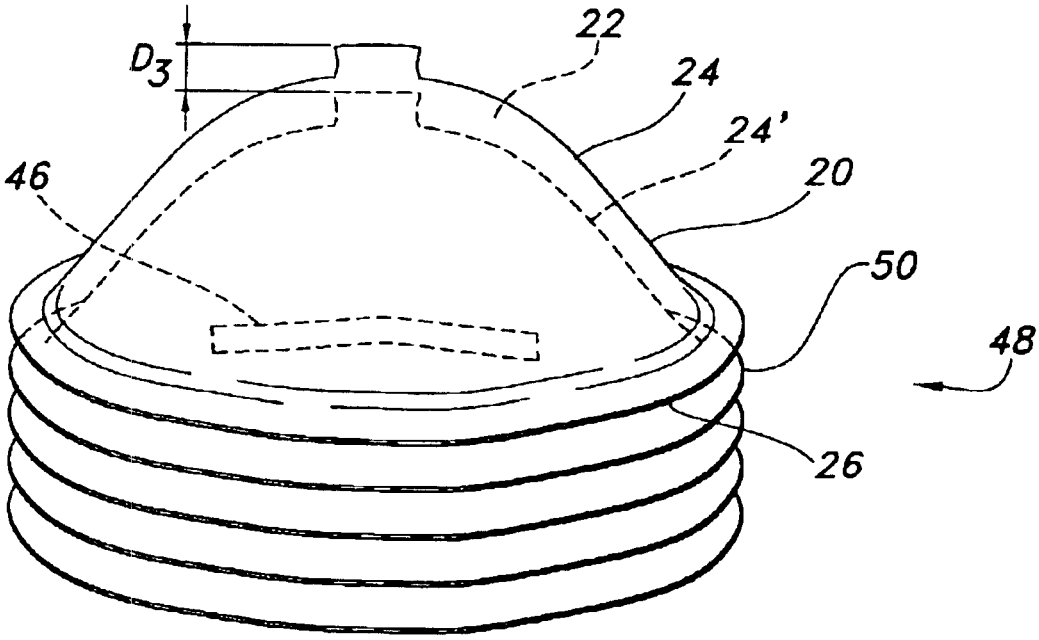
FIG. 5 is a side plan view of a plurality of face masks shown in FIG. 4 placed in a stacked configuration.

To facilitate gripping, the mask 20 of the present invention may include at least one tab 40 disposed on the outside surface 24, as depicted in FIGS. 2, 4, and 5. The tab 40 extends outwardly from the outside surface 24 and is adapted to be gripped by the wearer for dispensing and donning. The tab 40 may be integral (FIG. 2) to the outside surface 24, i.e., it may be formed contemporaneously with the mask 20, so that the tab 40 is merely an extension of the outside surface 24 rather than a separate component affixed to the mask 20 during manufacturing or otherwise. The tab 40 may alternatively be a separate component (FIG. 4) that is affixed to the outside surface 24 of the mask 20. In such embodiments, the tab 40 may be affixed to the outside surface 24 by stitching, thermal bonding, adhesive bonding, or by any other appropriate means.

The tab 40 may be located at any point on the outside surface 24 of the mask 20. In some embodiments, the tab 40 may be positioned in a substantially central region 42 on the outside surface 24 (FIGS. 2, 4, and 5). Such a point is generally distal to each point along the periphery 26. In this configuration, the tab 40 is positioned so that when the tab 40 is gripped, the mass of the mask 20 is substantially balanced in the wearer's hand, thereby stabilizing the mask 20 for donning.

The tab may be formed from any suitable material, such as an elastic material (e.g. a polymer), inelastic material, a nonwoven, knit, ribbon, cloth, wire, and so forth. As used herein, the term "elastic" refers to the ability of a material to recover its size and shape after deformation. As used herein, the term "inelastic" refers to the inability of a material to recover its size and shape after deformation. In some embodiments, the tab is formed from the same material selected to form the outside surface of the mask. The tab may, where desired, be substantially impervious to fluids.

Alternately, the tab may be impervious to liquids. In some embodiments, the tab is formed from a filtration material such as those described below.

The tab is generally sized to allow gripping with two or more fingers of a single hand. The tab may have any shape, including rectangular, circular, oval, trapezoidal, star, flared, tapered, or otherwise. In some embodiments, the tab has a projected area of at least about 10 $mm^2$ (0.0001 $m^2$). As used herein, the term "projected area" refers to the area of the tab that would project onto the outside surface of the mask. In other embodiments, the tab may have a projected area of at least about 20 $mm^2$ (0.002 $m^2$).

The tab 40 generally extends outwardly from the outside surface 24 a sufficient distance Z (FIG. 2) so that the wearer of the mask 20 may grip the tab 40 between two or more fingers of a single hand. In some embodiments, the tab 40 may extend outwardly from the outside surface 24 at least 5 mm (0.005 m). In other embodiments, the tab 40 may extend outwardly from the outside surface 24 at least about 8 mm (0.008 m). In yet other embodiments, the tab 40 may extend outwardly at least about 10 mm (0.01 m) from the outside surface 24. In some embodiments, the tab 40 may extend outwardly from the outside surface 24 a maximum distance of about 25 mm (0.025 m).

The tab may be tailored to suit the gripping characteristics of particular types of wearers. In some embodiments, the tab may be substantially rigid, so that a wearer can grip the tab without causing it to collapse. In other embodiments, the tab may be substantially deformable so that a wearer is able to compress the tab between two or more fingers when gripping it.

The presence of the tab on the outside surface of the mask enables the wearer to grasp the mask with a single hand, usually between the thumb and one or more fingers. The wearer is then able to bring the mask into contact with his or her face so that the periphery may be positioned in a comfortable location. In some embodiments, such as those shown in FIGS. 2 and 4, an adhesive material 44 may be applied to at least a portion the periphery 26 to enhance comfort, fit, efficacy, and so forth. As used herein, the term "adhesive" refers to the property of any material that allows the material to bond together substrates by surface attachment. In such embodiments, the mask may be donned with a single hand, thereby providing a significant advantage over many commercially available masks that require use of two hands to properly position and secure the mask on the wearer's face. Any adhesive material used must be suitable for application to the skin.

Certain polysiloxane adhesives are believed suitable for use with the present invention. One such adhesive material is described in U.S. Pat. No. 5,618,281 to Betrabet et al., incorporated herein by reference in its entirety. Other suitable adhesive materials include those described in U.S. Pat. No. 5,658,270 to Lichstein, incorporated herein by reference in its entirety. However, it is contemplated that other suitable pressure-sensitive adhesive materials known in the art may be used with the present invention.

Alternatively, a temperature-sensitive adhesive material that is substantially nontacky at or below about 25° C. that becomes tacky upon contact with skin may be used. As used herein, the term "substantially nontacky" refers to a substance that exhibits a tack of less than about 5 $g/cm^2$ of force as measured by ASTM D2979. As used herein, the term "tacky" refers to a substance that exhibits a tack of at least about 10 $g/cm^2$ of force as measured by ASTM D2979. In this test, the tack value is expressed as grams of force required to remove the end of a stainless steel rod 5.0 mm in diameter from the surface of an adhesive material coating at a speed of 10 mm per second to which it has been adhered for 1.0 second. Suitable adhesive materials have a narrow melting transition range to ensure a rapid change from a substantially nontacky state to a tacky state. By way of example only, suitable temperature-sensitive adhesive materials are provided by U.S. Pat. No. 5,156,911 to Stewart, incorporated herein by reference in its entirety. However, it is contemplated that other suitable temperature-sensitive adhesive materials known to those of skill in the art may be used with the present invention.

The face mask may also incorporate any combination of known features, such as visors or shields, beard covers, etc. Ear loops may also be attached to the mask proximal to the periphery so that if the medical personnel is required to remain in the sterile environment for an extended period of time, the worker is able to don the ear loops to further secure the mask to the face (not shown). The mask may also include an elongated malleable member 46 as shown in FIGS. 1, 2, 4, and 5 disposed proximal to at least a portion of the periphery 26 for configuring the mask 20 to closely fit the contours of the nose and cheeks of the wearer. The malleable member 46 may be made of any malleable material including, but not limited to, metal wire or an aluminum band. In some embodiments, the malleable member 46 may be disposed between the inside surface 22 and the outside surface 24.

The present invention also contemplates positioning a plurality of masks described above in a stacked configuration as depicted in FIG. 5. The masks 20 and 50, for example, are positioned in a nestled relation to one another with the inside surface 22 of one mask 20 being apposed to the outside surface 24' of an adjacent mask 50. As used herein, the term "apposed" refers to a juxtaposed or proximal relation. The presence of the tab 40 on the outside surface 24 of the mask 20 creates and maintains a distance D3 between apposed masks 20 and 50 so that the periphery 26 of one mask 20 does not contact the outside surface 24' of an adjacent mask 50. In some embodiments, a distance D3 of at least 3 mm (0.003 m) is maintained. In other embodiments, a distance D3 of at least about 5 mm (0.005 m) is maintained. In yet other embodiments, a distance D3 of at least about 8 mm (0.008 m) is maintained. In still other embodiments, a distance D3 of at least about 10 mm (0.01 m) is maintained.

As stated above, some mask embodiments may include an adhesive material on at least a portion of the periphery. Due to the presence of the tab on the outside surface and the distance maintained thereby, such masks may be placed in a stacked configuration without having the adhesive material contact the outside surface of the apposed mask. Thus, in some embodiments, there may not be a need for a release paper to be used in conjunction with the adhesive material. Thus, the wearer may easily remove a mask from the stack and don it with a single hand.

The face mask of the present invention may be formed from a variety of materials and fabrics, such as woven reusable fabrics and nonwoven disposable fabrics or webs. As used herein, the term "nonwoven fabric" or "nonwoven web" or "nonwoven material" means a web having a structure of individual fibers or threads that are randomly interlaid, but not in an identifiable manner or pattern as in a knitted fabric. Nonwoven fabrics or webs have been formed from many processes, for example, meltblowing processes, spunbonding processes, and bonded carded web processes.

As used herein, the term "spunbond" or "spunbond fibers" or "spunbonded fibers" refers to small diameter fibers that are formed by extruding molten thermoplastic material as filaments from a plurality of fine, usually circular capillaries of a spinneret with the diameter of the extruded filaments then being rapidly reduced, for example, as in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al.

As used herein, the term "meltblown" or "meltblown fibers" means fibers formed by extruding a molten thermoplastic material through a plurality of fine, usually circular, die capillaries as molten threads or filaments into converging high velocity, usually hot, gas (e.g. air) streams that attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al.

The face mask may be formed from a single layer of material or a composite of multiple layers. In the case of multiple layers, the layers are generally positioned in a juxtaposed or surface-to-surface relationship and all or a portion of the layers may be bound to adjacent layers. The multiple layers of a composite may be joined to form a multilayer laminate by various methods, including but not limited to adhesive bonding, thermal bonding, or ultrasonic bonding. One composite material suitable for use with the present invention is a spunbond/meltblown/spunbond (SMS) laminate. An SMS laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Multilayer laminates may have multiple meltblown layers or multiple spunbond layers in many different configurations and may include materials other than nonwovens. Examples of such other materials include wovens, films, foam/film laminates and combinations thereof, for example, a spunbond/film/spunbond (SFS) laminate. Examples of other composite materials suitable for use in the present invention include, but are not limited to, those described in U.S. Pat. No. 4,041,203 to Brock et al., U.S. Pat. No. 5,169,706 to Collier, et al., U.S. Pat. No. 5,145,727 to Potts et al., U.S. Pat. No. 5,178,931 to Perkins et al., U.S. Pat. No. 4,350,888 to Bornslaeqer, and U.S. Pat. No. 5,188,885 to Timmons et al., which are all incorporated herein by reference.

The face mask of the present invention may include a layer of material, for example, a nonwoven material, suitable for filtration. The filtration material may be made from a meltblown nonwoven web and, in some embodiments, may be subject to electret treating. As used herein, the term "electret" or "electret treating" refers to a treatment that imparts a charge to a dielectric material, such as a polyolefin. The charge includes layers of positive or negative charges trapped at or near the surface of the polymer, or charge clouds stored in the bulk of the polymer. The charge also includes polarization charges that are frozen in alignment of the dipoles of the molecules. Methods of subjecting a material to electret treating are well known by those skilled in the art. These methods include, for example, thermal, liquid-contact, electron beam, and corona discharge methods. One particular technique of subjecting a material to electret treating is disclosed in U.S. Pat. No. 5,401,466, the contents of which is herein incorporated in its entirety by reference. This technique involves subjecting a material to a pair of electrical fields wherein the electrical fields have opposite polarities. Electret treatment results in a charge being applied to the filtration medium that further increases filtration efficiency by drawing particles to be filtered toward the filter by virtue of their electrical charge. Electret treatment can be carried out by a number of different techniques. One technique is described in U.S. Pat. No. 5,401,446 to Tsai et al. assigned to the University of Tennessee Research Corporation and incorporated herein by reference in its entirety. Other methods of electret treatment are known in the art, such as that described in U.S. Pat. Nos. 4,215,682 to Kubik et al., 4,375,718 to Wadsworth, 4,592,815 to Nakao and 4,850,659 to Ando, incorporated herein by reference in their entirety.

Alternatively, the mask may include a layer of expanded polytetrafluoroethylene (PTFE) membrane for filtration, such as those manufactured by W. L. Gore & Associates. A more complete description of the construction and operation of such materials can be found in U.S. Pat. No. 3,953,566 to Gore and U.S. Pat. No. 4,187,390 to Gore, incorporated herein by reference in their entirety.

The minimum filtration efficiency requirements differ for various applications. The filtration efficiency of the face mask may be expressed in terms of its sodium chloride (NaCl) efficiency. The NaCl efficiency measures the ability of a fabric or web to prevent the passage of small particles (about 0.1 micron) through it. A higher efficiency is generally more desirable and indicates a greater ability to remove particles. The NaCl efficiency may be measured by an automated filter tester. One such apparatus is available from TSI, Inc., P.O. Box 64394, 500 Cardigan Rd, St. Paul, Minn. 55164, designated as the Model 8110 Automated Filter Tester (AFT). The Model 8110 AFT measures pressure differential and particle filtration characteristics for air filtration media. The AFT utilizes a compressed air nebulizer to generate a submicron aerosol of sodium chloride particles that serve as the challenge aerosol for measuring filter performance. The characteristic size of the particles used in these measurements is 0.1 micron. Typical air flow rates are between 31 liters per minute and 33 liters per minute. The AFT test is performed on a sample area of about 140 $cm^2$. The performance or efficiency of a filter medium is expressed as the percentage of sodium chloride particles that penetrate the filter, penetration being defined as transmission of a particle through the filter medium. The transmitted particles are detected downstream from the filter using a light scattering technique. The percent penetration (% P) reflects the ratio of the downstream particle count to the upstream particle count. In some embodiments, the mask may have a NaCl efficiency above 80 percent. In some other embodiments, the mask may have a higher filtration efficiency, for example, from about 95 percent to about 99.997 percent. In some embodiments, the maximum pressure differential through the mask may be less than 5 millimeters of water (mm H2O).

Where present, the filtration layer may also be required to attain a desired bacterial filtration efficiency (BFE). The BFE is a measure of the ability of a material to prevent the passage of bacteria through it. Face masks for medical applications may require a BFE of greater than or equal to about 96%. BFE may be measured according to military specification MIL-M-36954C, 4.4.1.1.1 and 4.4.1.2. The BFE is expressed as a percentage with a maximum efficiency of 100%. The BFE of a material may be measured, for instance, by Nelson Laboratories of Salt Lake City, Utah.

The invention may be embodied in other specific forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A face mask adapted to be donned with a single hand, comprising:

an inside surface having a periphery with an adhesive material disposed on at least a portion thereof;

an outside surface; and a tab disposed on and extending outwardly from the outside surface in a substantially central location generally distal from each point along the periphery, wherein the tab is adapted for gripping.

2. The mask of claim 1, wherein the tab is integral with the outside surface.

3. The mask of claim 1, wherein the tab is affixed to the outside surface.

4. The mask of claim 1, the tab extending outwardly at least 5 millimeters from the outside surface.

5. The mask of claim 1, the tab extending outwardly at least about 8 millimeters from the outside surface.

6. The mask of claim 1, the tab extending outwardly at least about 10 millimeters from the outside surface.

7. The mask of claim 1, the tab extending outwardly a maximum of about 25 millimeters from the outside surface.

8. The mask of claim 1, wherein the tab is substantially rigid.

9. The mask of claim 1, wherein the tab is substantially deformable.

10. The mask of claim 1, wherein the tab is substantially impervious to fluids.

11. The mask of claim 1, wherein the tab is sized to allow gripping with a single hand.

12. The mask of claim 1, wherein the mask is cup shaped.

13. The mask of claim 1, wherein the tab has a projected area of at least about 10 $mm^2$.

14. A stack of face masks comprising:

a plurality of shaped face masks each adapted to be donned with a single hand having an inside surface with a periphery, the periphery having an adhesive material disposed on at least a portion thereof, an outside surface, and a tab disposed on and extending outwardly from the outside surface in a substantially central location generally distal from each point along the periphery, the tab being adapted for gripping, wherein the masks are positioned in a nestled relation to one another, the inside surface of a mask being apposed to the outside surface of an adjacent mask, the tab maintaining a distance between apposed masks such that the periphery of a mask does not contact the outside surface of an apposed mask.

15. The stack of claim 14, wherein the distance between apposed masks is at least 3 millimeters.

16. The stack of claim 14, wherein the distance between apposed masks is at least about 5 millimeters.

17. The stack of claim 14, wherein the distance between apposed masks is at least about 8 millimeters.

18. The stack of claim 14, wherein the distance between apposed masks is at least about 10 millimeters.

* * * * *